US008329074B2

(12) United States Patent
Meredith et al.

(10) Patent No.: US 8,329,074 B2
(45) Date of Patent: Dec. 11, 2012

(54) DEVICE AND METHOD FOR REPAIRING MORTAR JOINTS BETWEEN CHIMMEY TILES

(75) Inventors: John E. Meredith, Richmond, IN (US); Thomas J. Urban, Fairfield, IA (US)

(73) Assignee: Merediths' Inc., Richmond, IN (US)

( * ) Notice: Subject to any disclaimer, the term of this patent is extended or adjusted under 35 U.S.C. 154(b) by 500 days.

(21) Appl. No.: 12/470,299

(22) Filed: May 21, 2009

(65) Prior Publication Data

US 2009/0291204 A1 Nov. 26, 2009

Related U.S. Application Data

(60) Provisional application No. 61/128,730, filed on May 23, 2008.

(51) Int. Cl.
*B29C 73/00* (2006.01)

(52) U.S. Cl. ..... 264/36.15; 264/36.16; 264/36.18; 264/36.2; 264/40.1; 425/11; 425/12; 425/171; 425/173; 425/184

(58) Field of Classification Search ..... 425/11, 425/12, 108, 169, 171, 173, 184, 188, 189; 264/36.1, 36.15, 36.16, 36.18, 36.2, 40.1; 118/713

See application file for complete search history.

(56) References Cited

U.S. PATENT DOCUMENTS

| | | | | |
|---|---|---|---|---|
| 4,627,471 | A * | 12/1986 | Parkes et al. | 138/97 |
| 5,109,567 | A | 5/1992 | Harrison | |
| 5,180,210 | A * | 1/1993 | Lister | 299/70 |
| 5,333,349 | A * | 8/1994 | Lister | 15/235.8 |
| 5,527,169 | A * | 6/1996 | Goldenberg et al. | 425/11 |
| 5,655,256 | A | 8/1997 | Hendrix et al. | |
| 5,813,089 | A | 9/1998 | Nolan et al. | |
| 6,966,950 | B2 * | 11/2005 | Winiewicz et al. | 118/712 |
| 6,969,427 | B1 * | 11/2005 | Noles, Jr. | 118/317 |
| 7,658,804 | B1 | 2/2010 | Cano | |
| 2003/0067087 | A1 * | 4/2003 | Gozu et al. | 264/36.16 |

(Continued)

FOREIGN PATENT DOCUMENTS

CA 2307713 A1 * 11/2001

(Continued)

OTHER PUBLICATIONS

Installation-Chimney & Flues- Ornamental from http://www.ornamental.com/cf-installation.php (3 page), (Published or cpoyright year:2006)

(Continued)

*Primary Examiner* — Dimple Bodawala
(74) *Attorney, Agent, or Firm* — Woodard, Emhardt, Moriarty, McNett & Henry LLP

(57) ABSTRACT

A device for repairing a chimney preferably includes a rod effective for positioning and manipulating a camera and a plunger blade in a chimney; a camera attached to the lower portion of the rod in a manner such that rotation of the rod results in a corresponding rotation of the camera; and a plunger blade attached to the rod above the camera. The plunger blade is adapted to apply mortar to the sides of a chimney when the device is pulled upward in the chimney. The device may further include a camera-direction indicator attached to the rod above the plunger blade in a manner such that the camera-direction indicator is effective for indicating the direction of view of said camera even when the camera is not visible to the operator.

6 Claims, 7 Drawing Sheets

U.S. PATENT DOCUMENTS

| | | | | |
|---|---|---|---|---|
| 2004/0231089 | A1 | 11/2004 | Vilarasau Alegre | |
| 2005/0013889 | A1 * | 1/2005 | Endre | 425/90 |
| 2009/0260180 | A1 * | 10/2009 | Meredith et al. | 15/406 |

FOREIGN PATENT DOCUMENTS

| | | | |
|---|---|---|---|
| DE | 2 143 241 | A * | 3/1973 |
| JP | 08021616 | A * | 1/1996 |
| JP | 10184034 | A * | 7/1998 |

OTHER PUBLICATIONS

Landy Vent Installation from www.landyvent.co.uk/en/installation.htm (2 pages), (Published or copyright Year: 2004).

* cited by examiner

DEVICE AND METHOD FOR REPAIRING MORTAR JOINTS BETWEEN CHIMMEY TILES

REFERENCE TO RELATED APPLICATIONS

This application claims the benefit of U.S. Provisional Patent Application Ser. No. 61/128,730, filed May 23, 2008, which is hereby incorporated herein by reference.

FIELD OF THE INVENTION

The present invention relates generally to devices for repairing a chimney, and more particularly to a device for repairing mortar joints between clay chimney tiles.

BACKGROUND TO THE INVENTION

It has been estimated that nearly half of all masonry chimneys that are lined with sections of clay flue tile have at least one joint (the juncture between the each section) that has deteriorated and needs to be replaced. This can create a potentially hazardous condition for the occupants. The purpose of a chimney is to contain and convey the products of combustion to the outside. If the chimneys liner contains gaps and voids, it can no longer be relied on to function for its intended purpose.

All nationally recognized building codes (National Fire Protection Association 211 Standard for Chimneys & International Residential Building Code-R1001.9 Flue lining installation) call for flue liners to be joined together and sealed with a non-water-soluble refractory cement that meets ASTM C199 medium duty classification. Unfortunately, it has been found that during the original construction, builders often use standard mortar to lay or seal flue tile sections. Because standard mortar is water soluble and not meant for high heat applications, joints constructed with standard mortar may deteriorate more rapidly than sections joined together and sealed with refractory mortar.

Because most residential chimney flues are long narrow tubes, it is nearly impossible to repair chimneys that are found to have this condition. Until now the only reliable method has been to tear down the chimney and rebuild it or to line the existing chimney flue with stainless steel pipe.

A need therefore exists for a method and device for repairing mortar joints between chimney tiles. The present invention addresses that need.

SUMMARY OF THE INVENTION

In one aspect of the present invention there is provided a device for cleaning a chimney. The device preferably includes a rod effective for positioning and manipulating a plunger blade in a chimney; at least one camera attached to the rod in a manner such that rotation of the rod results in a corresponding rotation of the camera; and a plunger blade attached to the rod above the camera. The plunger blade is sized to be slightly larger than the size of the chimney interior so that when the plunger blade is in place a repair material may be poured onto the plunger from above and the plunger will hold the material and keep it from dropping down below the plunger. Then, when the device is pulled upward in the chimney, the plunger blade presses the repair material into any cracks or holes in the chimney interior, and particularly in defective or deteriorated joints. The camera is used to view the chimney interior before and/or after repair. The device may further include a camera-direction indicator attached to the rod above the plunger blade in a manner such that the camera-direction indicator is effective for indicating the direction of view of said camera even when the camera is not visible to the operator.

DESCRIPTION OF THE PREFERRED EMBODIMENTS

Figure 1:
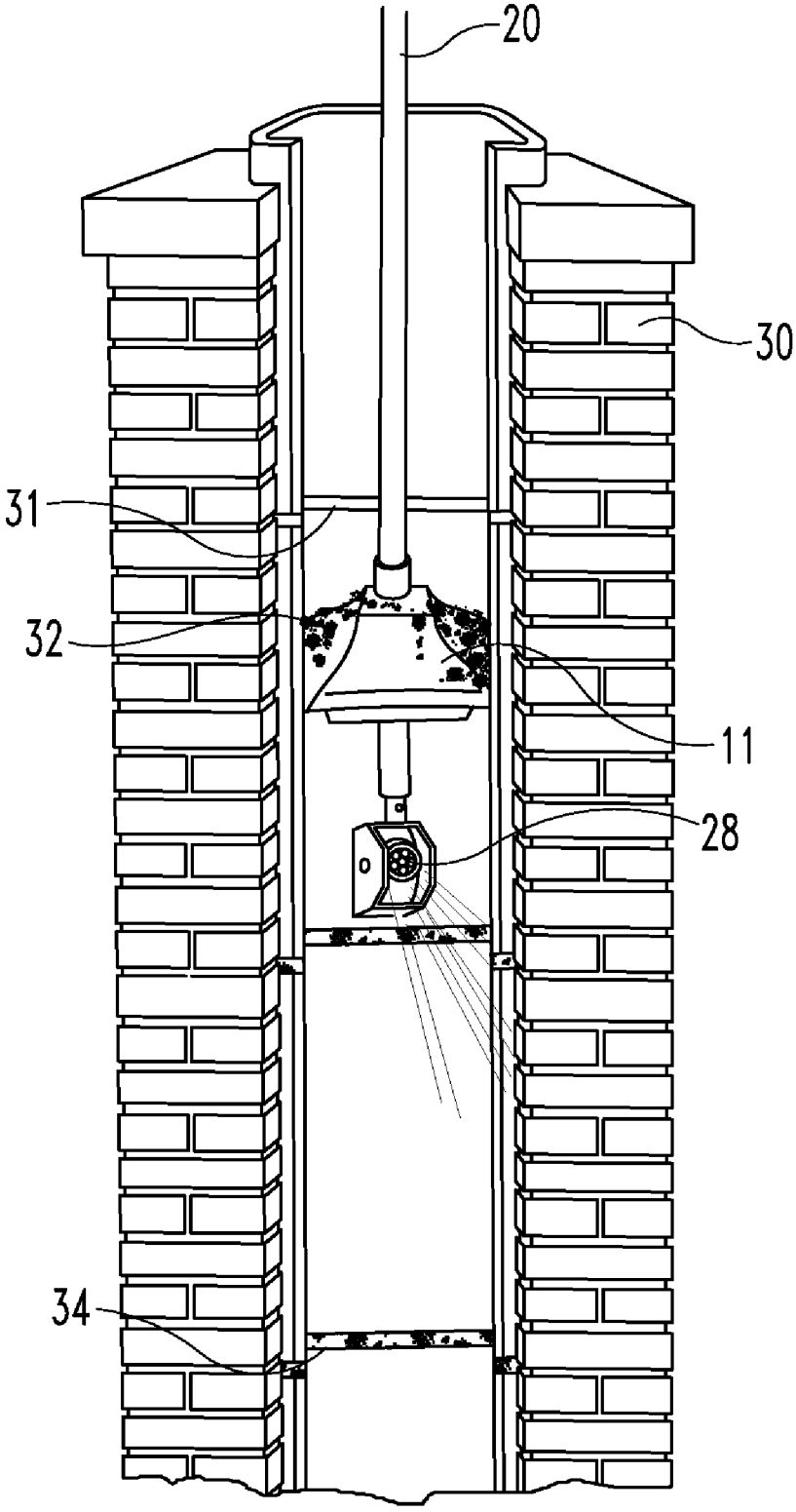
FIG. 1 shows a perspective view of the inventive tool being used for the inventive method, according to one embodiment.

For the purposes of promoting an understanding of the principles of the invention, reference will now be made to certain embodiments and specific language will be used to describe the same. It will nevertheless be understood that no limitation of the scope of the invention is thereby intended. Instead, the claims of the application are intended to cover all alterations and further modifications in the illustrated invention, and such further applications of the principles of the invention disclosed herein, as would normally occur to one skilled in the art to which the invention relates.

One aspect of the present invention provides a method and device for repairing joints in a clay-tile lined chimney. The device comprises a plunger on a rod, wherein the plunger is sized to be just larger than the interior of a chimney to be repaired. A repair material, which may be any mortar-like material, including particularly a non-water-soluble, medium duty refractory cement, is poured from above on the plunger so that the repair material flows down over the top of the plunger. The plunger is then pulled up, thereby pushing the mortar material into any cracks or spaces in or between the chimney tiles. A camera may be mounted on the rod to allow the user to observe the inside of the chimney before, during, or after the repair.

While additional applications are intended to be within the scope of the present invention, the materials and methods of the present invention find particular utility with field-installation into new or existing masonry chimneys that are used for the natural draft venting of Category I gas-fired, Type L vented oil-fired, or solid-fuel-fired residential-type appliances in which the maximum continuous flue-gas outlet temperatures do not exceed 1000° F. (538° C.).

1. The Plunger/Camera Assembly.

In one embodiment the device includes a plunger assembly attached to a rod effective for positioning and manipulating the plunger assembly in a chimney. A camera may also be provided on the rod, above and/or below the plunger blade. A spreader paddle, which may also function as an indicator of the camera's orientation, may also be provided above the plunger blade.

The rod may be any rod effective for supporting and positioning the plunger assembly and any related camera and spreader paddles. In one preferred embodiment the rods are standard chimney sweep rods, which may have connection hardware at each end to allow sections of rods to be joined together. Sections of rod may be added as needed to properly position and use the device.

The plunger assembly includes a plunger blade effective for pushing mortar material into joints in a chimney. The plunger blade may be supported by a plunger blade support plate below, and a plunger head above. The plunger blade support plate and the plunger head provide support and stabilize the plunger blade and help it to maintain the rigidity necessary to effectively push mortar material into chimney joints. Associated hardware such as top and bottom retainer plates may be used to hold the plunger head, plunger blade, and plunger blade support plate together when installed on the rod.

The plunger blade is preferably cut to a size and shape that generally matches, but is slightly larger than, the shape of the chimney. For example, a plunger blade having a width/length that is about 1" wider/longer than the opening of the chimney may be used so that the plunger folds under about ½" all around when in use.

The plunger blade is preferably made of a material that is flexible enough to adapt to any chimney shape irregularities, yet firm or rigid enough to push mortar into the spaces that need to be repaired or filled. In one embodiment a 2 pound cross-linked polyethylene closed cell foam, or the functional equivalent, may be used.

The plunger assembly is attached to the rod in a manner such that rotation of the rod does not rotate the plunger assembly when the assembly is positioned in a chimney. For example, a sleeve may be used to isolate the plunger assembly from the rod so that the rod is free to rotate in the sleeve without rotating the plunger.

A camera may be provided on the rod near the plunger assembly. In one embodiment a camera is provided near the lower end of the rod, below the plunger assembly. The camera may be a still camera or a video camera, but in either case it should be effective for viewing the interior of a chimney when the camera is provided on the rod in a chimney. The camera is fixed to the rod in a manner such that the field of view of the camera is controllable by rotating the rod around its axis in the chimney.

The camera may be linked to a recording device to record what the camera observes. In other embodiments multiple cameras, including cameras above and below the plunger, may be provided on the device. In some embodiments the camera is provided with controls that allow it to be directed up or down as desired by the operator.

A spreader paddle may be provided above the plunger assembly. The spreader paddle may serve two purposes: it may spread mortar or other repair material over the plunger head and/or the plunger blade and into the chimney joints, and it may provide an indicator of the direction of view of the camera. Accordingly, the spreader paddle should be fixed with respect to the camera so that any rotation of the rod that rotates the camera provides a corresponding rotation of the spreader paddle. The spreader paddle may be connected to the rod by a spreader head that facilitates rotation of the spreader paddle around the rod. By rotating the rod with the spreader paddle and camera (both of which can be manually turned 360 degrees) the successful repair can be viewed on a monitor positioned on top of the chimney.

The spreader paddle is preferably made of a material that is rigid enough to push mortar into spaces that need to be repaired or filled. While this element is preferably made of a hard plastic material, it is to be appreciated that in some embodiments this piece is not made of hard plastic. For example, the piece may be made of metal or another material that has the performance characteristic of being able to push mortar into flue voids, preferably while being resistant to corrosion and/or deterioration from contact with mortar material.

The spreader paddle also should be made of a material that is easily visible when looking down a 15 or 20 foot (or longer) chimney flue. In some embodiments the spreader paddle is adjustable as to its angle and/or reach to allow it to adapt to various chimney sizes and shapes.

The spreader paddle and the camera are attached to the rod in a manner in which rotation of the rod causes a corresponding rotation of the camera and the spreader paddle. In one embodiment, locking levers may be used in conjunction with tabs or bolts to allow the camera and/or the spreader paddle to be "locked" onto the rod. In one embodiment the camera and/or the spreader paddle are releasably "locked" onto the rod.

The spreader paddle may be provided with controls that allow it to be manipulated while the mortar is being applied. Such controls may provide the ability to push mortar up or down in addition to being able to push mortar around the circumference of the flue.

In the embodiment illustrated in the accompanying drawings the chimney tiles are substantially square, but it is to be appreciated that the invention may be provided for chimneys of virtually any shape. Common shapes include rectangular (including square) and oval chimney tiles, with the corners of rectangular embodiments optionally being rounded such as illustrated herein.

2. The Mortar Material.

The mortar material may be made of a blend of inorganic materials and inert aggregates together with a high temperature resin bonding agent. In one embodiment, the inert aggregates includes 50-80% $Al_2O_3$ and 10-40% $SiO_2$.

The flowable refractory material is preferably a high temperature, castable or moldable refractory coating capable of withstanding temperatures of at least 2100° F., more preferably at least 2300° F., and most preferably at least 2500° F. In some embodiments the flowable refractory material utilizes a (wet or dry) water based inorganic binder system that is resistant to hot gases, flame, water and chemical erosion. The flowable refractory material may be provided as a one- or a two-component system.

Preferably, the flowable refractory material comprises a material that will air dry in no more than 48 hours (at ambient temperatures of 10-35° C.) to a hard, abrasion resistant, non-water-soluble coating. In some embodiments the flowable refractory material may require increased air flow (fans, etc.) or increased temperatures (above 35° C.) to harden to an abrasion resistant coating. The flowable refractory material may comprise a material that can be fired at a low temperature (e.g., less than 300° C.) for 24 to 48 hours until it is completely cured.

The flowable refractory material must be capable of adhering to the substrate to which it is applied, preferably without sagging, slumping, or flowing off of the surface when wet. In some preferred embodiments the flowable refractory material also provides good insulating properties and/or good thermal shock resistance. The flowable refractory material should have good chemical stability and not react with flue gasses or chimney components under normal (or even extreme) operating conditions.

The material should be viscous enough to form a slurry that can be easily applied yet evenly fills the cracks in, or spaces between, chimney tiles. If the material is too thick or too thin, the material may be difficult to apply or may not provide an adequate repair.

The mortar material may include a blend of inorganic minerals and binders, and may include ceramic fibers. The preferred material is Eldfast made by the Fa: J. Kikson Company, Vallentuna, Sweden. Eldfast is a ceramic material that does not contain cement or lime. It is composed of a blend of inorganic materials and inert aggregates together with a high temperature resin bonding agent in a powdered or liquid form. When these ingredients are mixed with water the result is a slurry that is flowable. It chemically sets and is water and acid resistant. The composition comprises 60-80% $Al_2O_3$ and 40-20% $SiO_2$.

3. The Method of Use.

The plunger assembly is inserted into the chimney, preferably from the top. It is lowered below the portion of the chimney that is to be repaired, preferably 6"-12" below that portion. The plunger may then be pulled upwards to reverse the curve of the plunger blade so the ends of the blade are curled under. The plunger blade is positioned approximately 2" below the mortar joint that is missing mortar. The repair material is then poured in from the top chimney opening until the void from the missing mortar joint is no longer visible when viewed from above in appropriate light. The rod is then manually pulled upward, forcing the refractory cement into the void and wiped flush by the passing over foam blade. The camera that is mounted below the foam plunger may be manipulated to view the chimney interior.

In another embodiment the inventive tool may be used to reline a chimney, or to apply virtually any material to the interior surface of a chimney. The same basic method is applied, with the plunger being lowered to the bottom of a chimney and a flowable material being poured in from above. When the plunger is pulled up the material is spread on the insider surface of the chimney.

Referring now to the drawings, FIG. 1 shows a perspective view of the inventive tool being used for the inventive method, according to one embodiment. Plunger assembly 11 is positioned in chimney by using rod 20 to push the plunger assembly and camera 28 into the chimney. Repair material 32, which may be mortar or another chimney-repair material, has been provided on plunger assembly 11 so that the plunger may push the material into chimney joints 31. A repaired joint 34 results.

Figure 2:
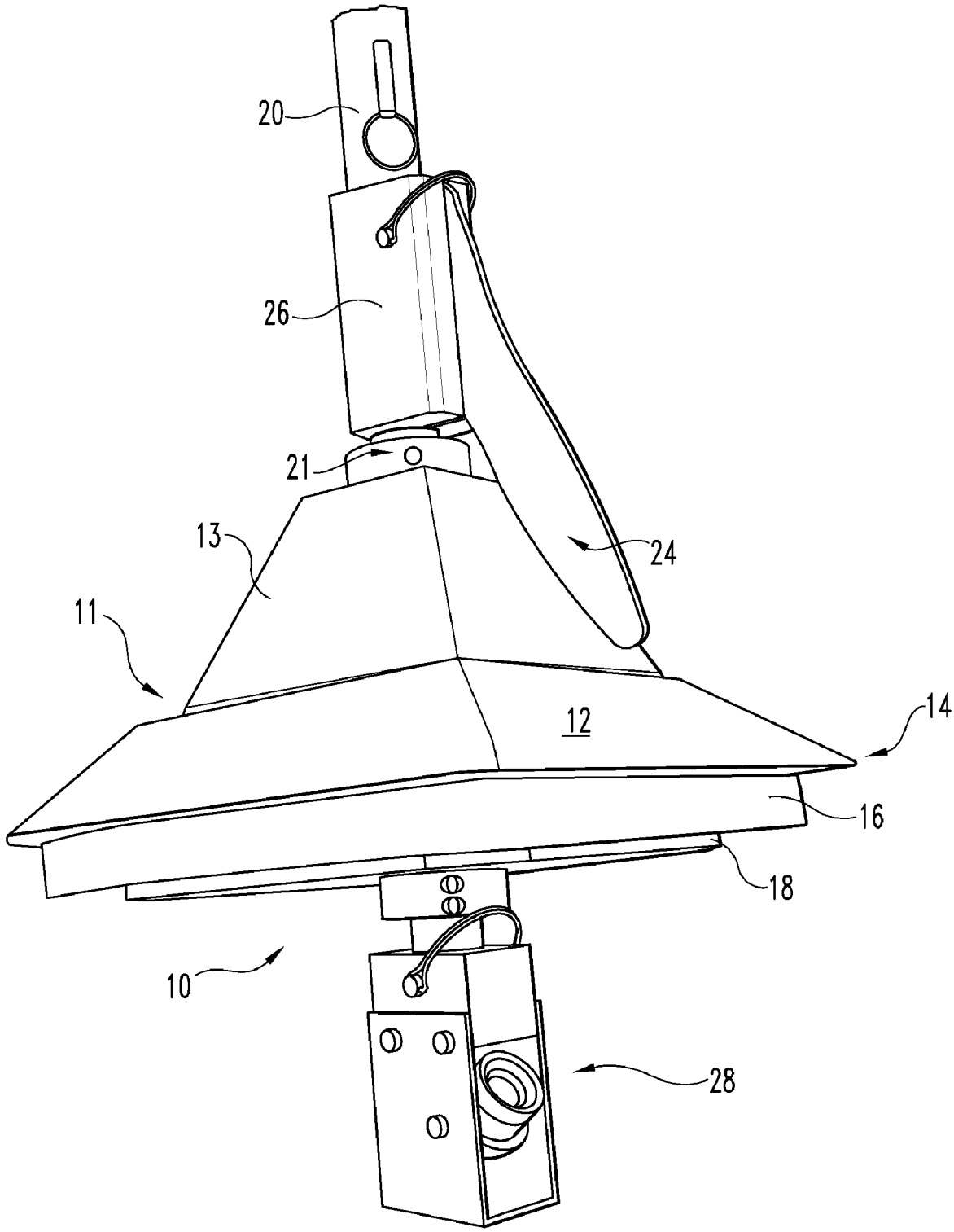
FIG. 2 shows a perspective view of the inventive tool, according to one embodiment.

FIG. 2 shows a perspective view of the inventive tool, according to one embodiment. Plunger/camera assembly 10 includes a plunger assembly 11 that is sized to be slightly larger than the interior of a chimney flue to be treated. Plunger assembly 11 has a plunger blade 12 that slopes to a rim 14 to direct mortar or another repair material to the flue surface when mortar is dropped onto the plunger from above. Plunger blade support plate 16 lends rigidity and support to plunger blade 12.

Plunger assembly 11 is mounted on rod 20 which extends both above and below the assembly. As indicated above, a sleeve may be provided to facilitate rotation of the rod through plunger 10 without turning the plunger.

A spreader paddle 24 is mounted to rod 20. Spreader paddle 24 is fixed to rod 20 such that rotation of rod 20 additionally rotates spreader paddle 24.

A camera 28 is provided on rod 20 below plunger 11. The camera may be in a fixed orientation (although generally rotatable), or it may be capable of being maneuvered to view higher or lower when desired. Camera 28 is also preferably fixed to rod 20 such that rotation of rod 20 rotates camera 28.

Figure 3:
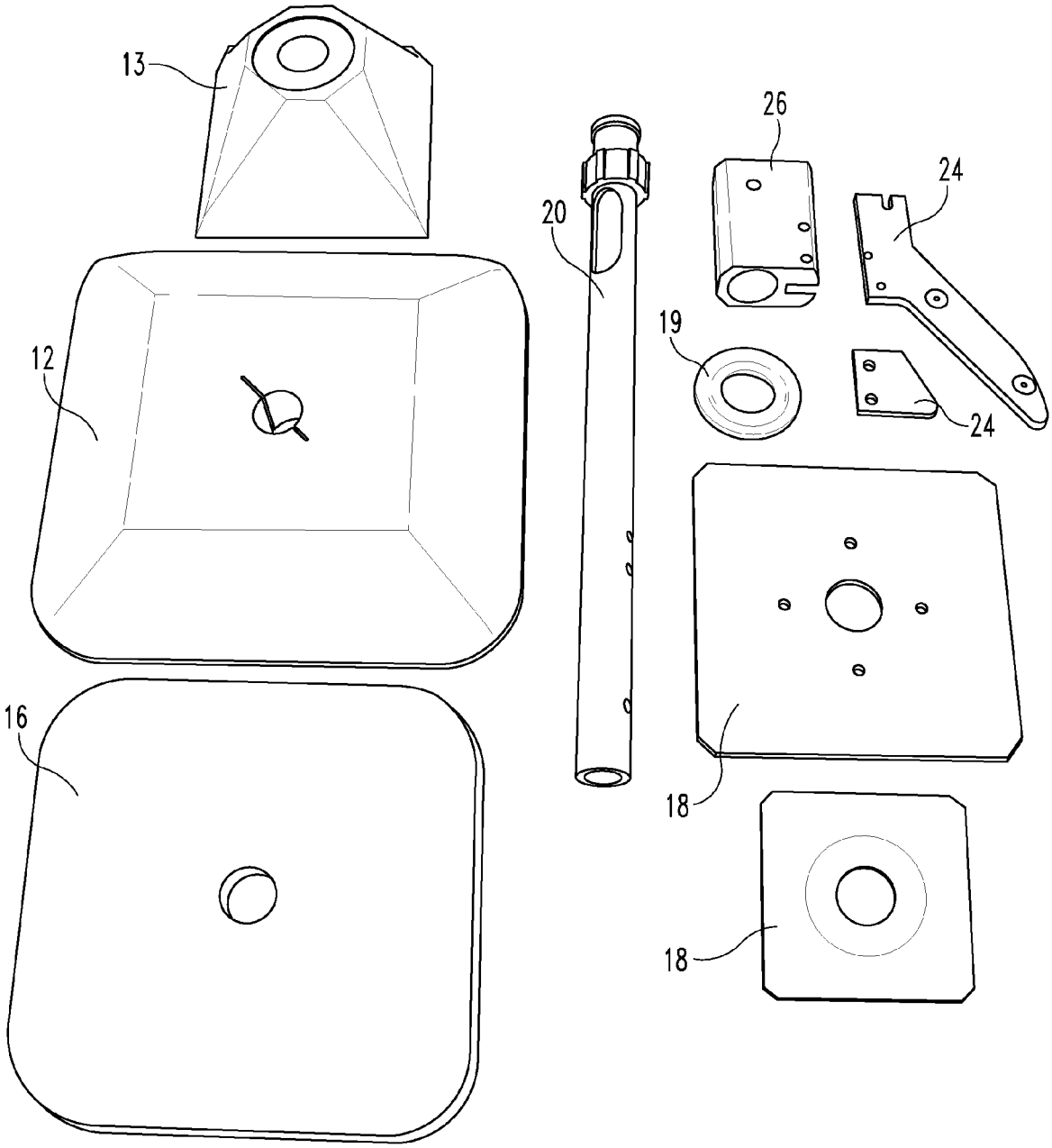
FIG. 3 shows the components of the plunger assembly of the inventive tool, according to one embodiment.

FIG. 3 shows the components of the plunger assembly of the inventive tool, according to one embodiment. Plunger head 13, plunger blade 14, plunger blade support plate 16, spreader head 26, spreader paddle 24, retainer ring 19, and retainer plates 18 are shown, as is rod 20.

Figure 4:
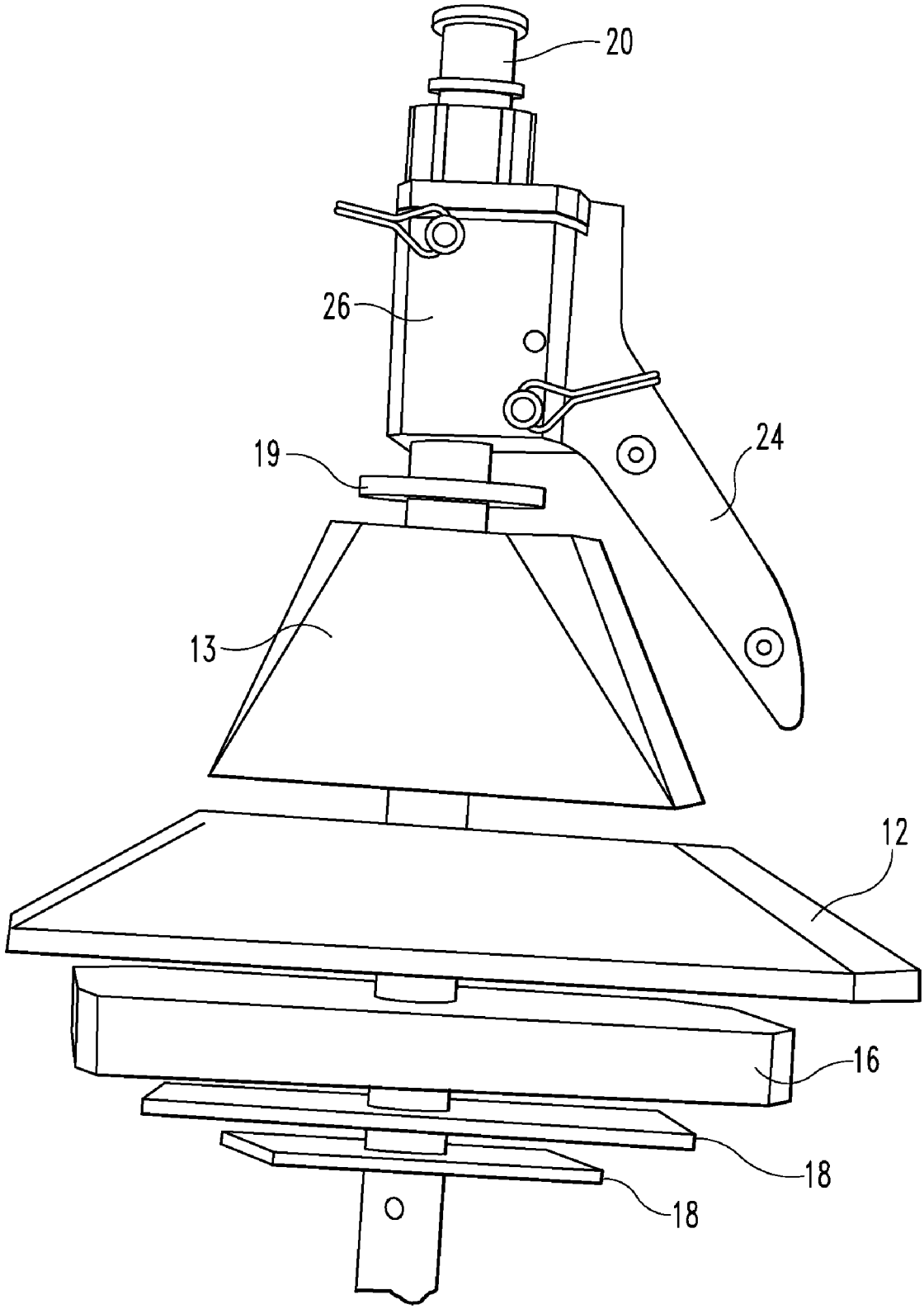
FIG. 4 shows a semi-exploded view of the plunger assembly of the inventive tool, according to one embodiment.

FIG. 4 shows a semi-exploded view of the plunger assembly of the inventive tool, according to one embodiment. Spreader head 26 holds spreader paddle 24 on rod 20 such that rotation of the rod correspondingly rotates the spreader paddle. Retainer ring 19 and retainer plates 18 hold plunger head 13, plunger blade 14, and plunger blade support plate 16 in place on the rod. A lock nut or locking screw 21 may be used to hold the pieces in place. A sleeve (not illustrated) may be used to isolate the plunger assembly so that rotation of the rod does not result in rotation of the plunger assembly.

Figure 5:
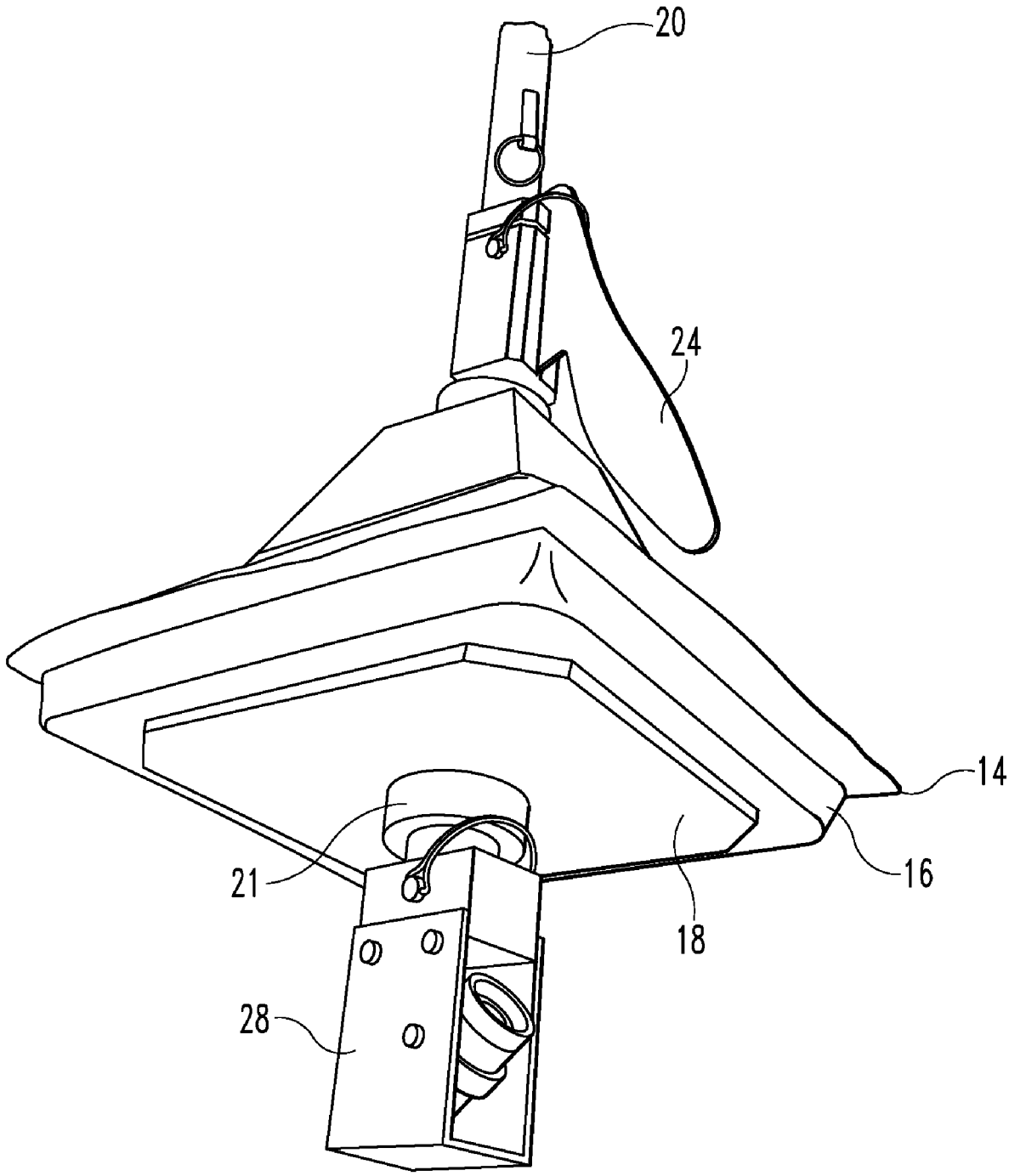
FIG. 5 shows a perspective view of the inventive tool, according to one embodiment.

FIG. 5 shows a perspective view of the inventive tool, according to one embodiment. Rod 20 holds spreader blade 24 above plunger assembly 11 and camera 28.

Figure 6:
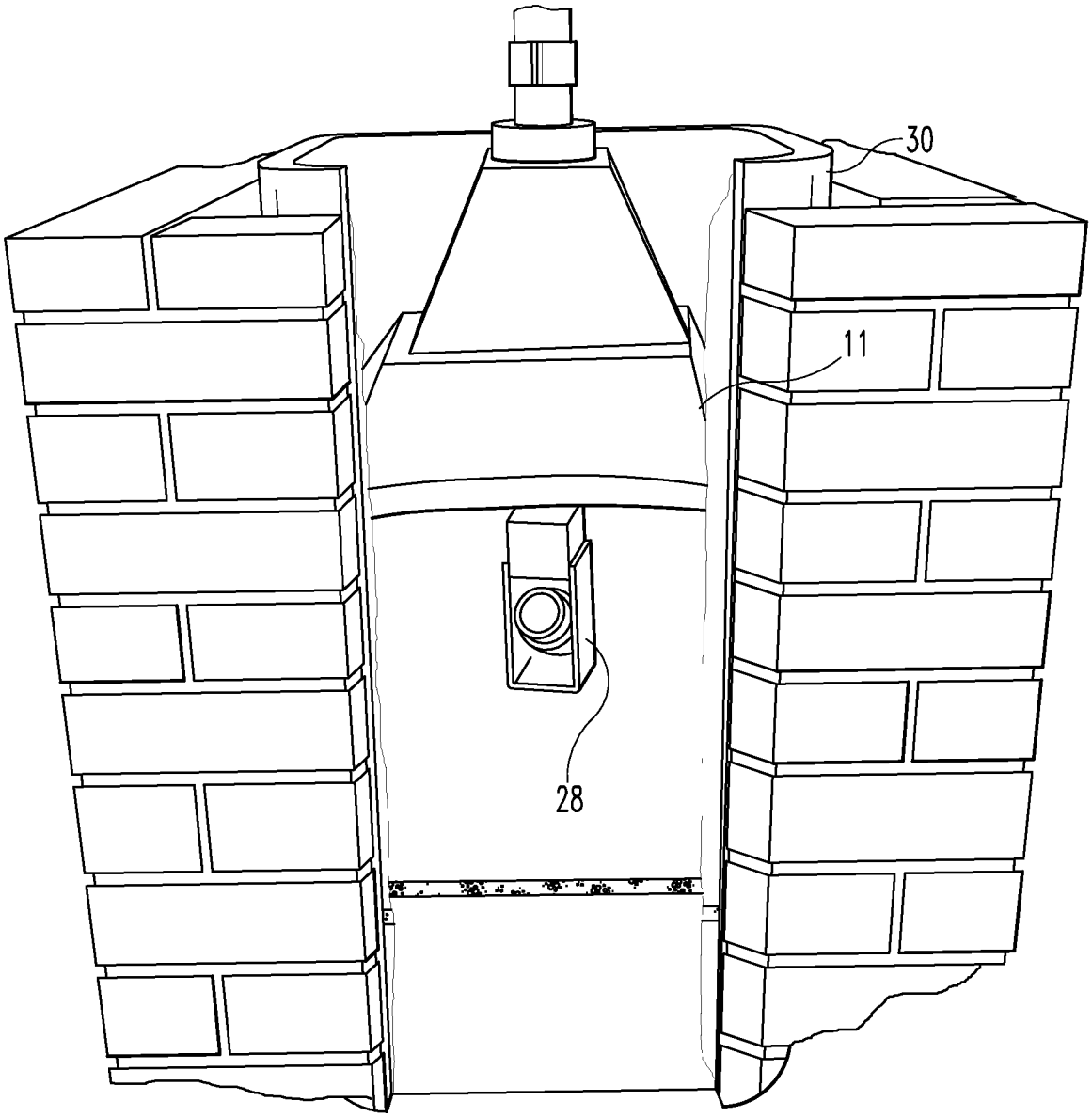
FIG. 6 shows a perspective view of the inventive tool in a chimney (in partial section), according to one embodiment.

FIG. 6 shows a perspective view of the inventive tool in a chimney (shown in partial section, with the front part of the chimney cut away), according to one embodiment. Plunger assembly 11 is positioned so as to receive mortar from above and to be pulled upward to push mortar into joint 30.

Figure 7:
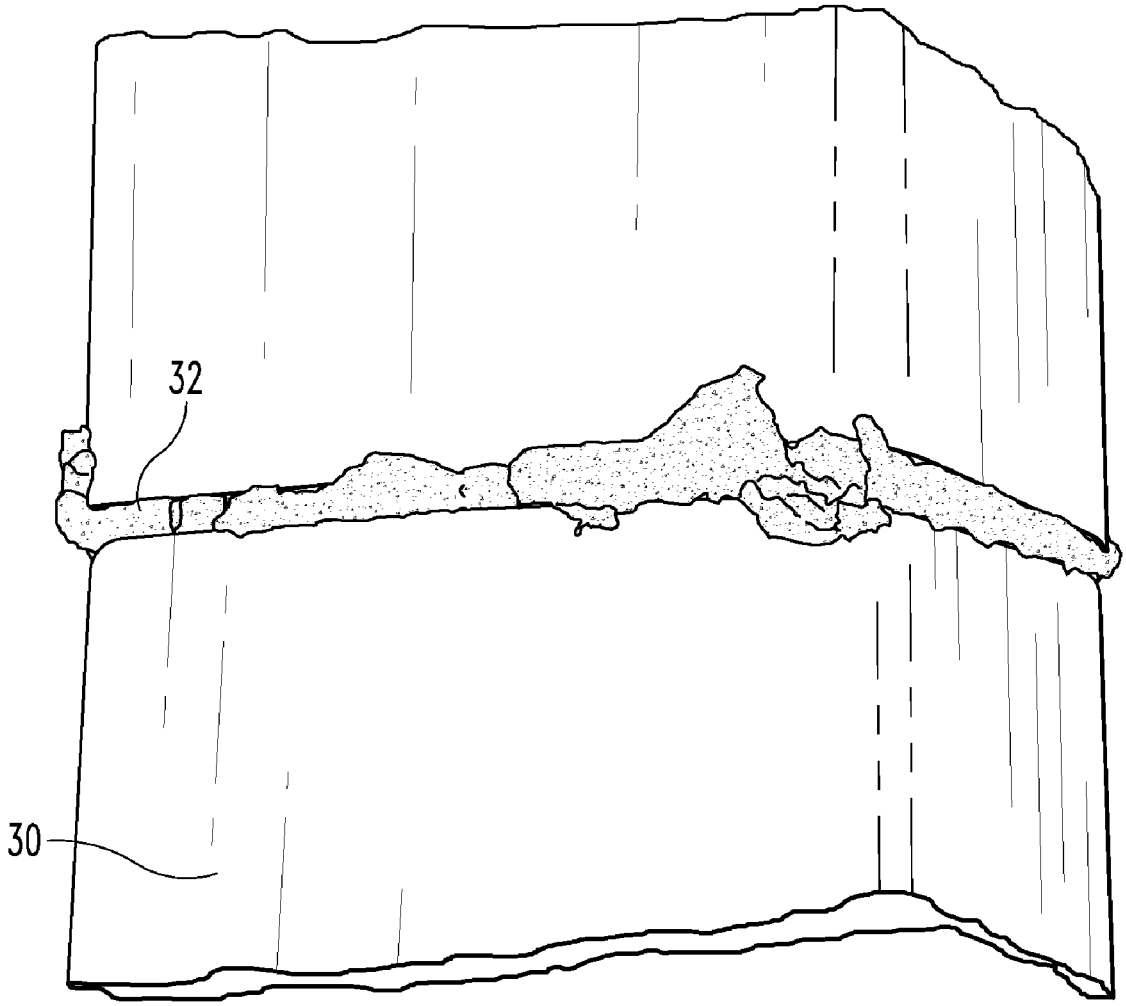
FIG. 7 shows an exterior view of a chimney joint filled with mortar after being repaired by the inventive tool according to the inventive method, according to one embodiment.

FIG. 7 shows an exterior view of a chimney joint filled with mortar after being repaired by the inventive tool according to the inventive method. Mortar or other repair material 32 fills the joint in the repaired chimney 30.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A method of using a joint repair device for repairing joints in a chimney, the method comprising:

a) providing said joint repair device in a lower portion of the chimney, wherein said joint repair device comprises:

i) a rod having a lower portion and an upper portion, wherein said rod is effective for positioning a plunger blade in the chimney and for positioning and rotationally manipulating a camera in the chimney;

ii) said camera attached to the lower portion of the rod in a manner such that rotation of the rod results in a corresponding rotation of said camera about the axis of rotation of the rod;

iii) said plunger blade attached to said rod above said camera, wherein said plunger blade is adapted to apply mortar to the sides of the chimney when the device is pulled upward in the chimney, and wherein said plunger blade is attached to said rod in a manner such that rotation of the rod in the chimney does not result in a corresponding rotation of the plunger blade; and iv) a spreader paddle located above said plunger blade and fixed with respect to said camera such that said spreader paddle is effective for indicating the direction-of-view of said camera;

b) providing a chimney repairing composition above said plunger blade;

c) using said rod to pull said camera and said plunger blade upward, thereby causing said plunger blade to scrape excess chimney repairing composition from the wall of the chimney while pushing the chimney repair composition into cracks or joints of the chimney wall; and d) using said rod to manipulate said camera to view the inside of the chimney while using said spreader paddle to indicate the direction of view of said camera.

2. A joint repair device for repairing joints in a chimney, wherein said device comprising:

a) a rod having a lower portion and an upper portion, wherein said rod is effective for positioning a plunger blade in the chimney and for positioning and rotationally manipulating a camera in the chimney;

b) said camera attached to the lower portion of the rod in a manner such that rotation of the rod results in a corresponding rotation of said camera about the axis of rotation of the rod;

c) said plunger blade attached to said rod above said camera, wherein said plunger blade is adapted to apply mortar to the sides of the chimney when the device is pulled upward in the chimney, and wherein said plunger blade is attached to said rod in a manner such that rotation of the rod in the chimney does not result in a corresponding rotation of the plunger blade; and d) a spreader paddle located above said plunger blade and fixed with respect to said camera such that said spreader paddle is effective for indicating the direction-of-view of said camera.

3. A device according to claim 2 wherein the device further includes a sleeve for mounting the plunger blade on the rod in a manner such that rotation of the rod in the chimney does not result in a corresponding rotation of the plunger blade.

4. A device according to claim 2 wherein said plunger blade is made of a cross-linked polyethylene closed cell foam.

5. A method according to claim 1 wherein said plunger blade has a size and shape that generally matches, but is slightly larger than, the shape of the chimney.

6. A method according to claim 1 wherein said plunger blade has a size and shape that generally matches, but is slightly larger than, the shape of the chimney.

* * * * *